US008104877B2

(12) United States Patent
Kajiura

(10) Patent No.: US 8,104,877 B2
(45) Date of Patent: Jan. 31, 2012

(54) RECORDING HEAD AND MANUFACTURING METHOD THEREOF

(75) Inventor: Morimasa Kajiura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 308 days.

(21) Appl. No.: 12/561,162

(22) Filed: Sep. 16, 2009

(65) Prior Publication Data

US 2010/0073434 A1 Mar. 25, 2010

(30) Foreign Application Priority Data

Sep. 19, 2008 (JP) ..... 2008-240396

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS

| | | | | |
|---|---|---|---|---|
| 7,866,800 | B2 * | 1/2011 | Kubo et al. | 347/68 |
| 2003/0180986 | A1 | 9/2003 | Iizuka et al. | |
| 2007/0229606 | A1 | 10/2007 | Taira et al. | |

FOREIGN PATENT DOCUMENTS

| | | | |
|---|---|---|---|
| JP | 2002-036568 | A | 2/2002 |
| JP | 2003-332382 | A | 11/2003 |
| JP | 2005-050971 | A | 2/2005 |
| JP | 2007-237556 | A | 9/2007 |
| JP | 2007-268849 | A | 10/2007 |
| JP | 2008-183880 | A | 8/2008 |

OTHER PUBLICATIONS

Japan Patent Office; Notice of Reasons for Rejection for Application No. JP2008-240396, mailed Sep. 28, 2010.
Japan Patent Office; Notice of Decision for Final Rejection for Patent Application No. 2008-240396, mailed Jan. 25, 2011.

* cited by examiner

*Primary Examiner* — Matthew Luu
*Assistant Examiner* — Erica Lin
(74) *Attorney, Agent, or Firm* — Baker Botts L.L.P.

(57) ABSTRACT

A flat flexible substrate of a recording head has: a base having a surface facing an actuator unit, a plurality of lands placed on the surface and bonded to respective individual bumps, a plurality of wirings placed on the surface and connected to the respective lands, an insulating land cover layer covering parts of the respective lands other than the bonded points with the respective individual bumps, and an insulating wiring cover layer covering the wirings. The wiring cover layer and the land cover layer are placed on each other to form a layered part so that the wiring cover layer is sandwiched between the land cover layer and the wirings, and a piezoelectric layer and the wirings sandwich therebetween at least a part of the layered part. In the layered part, the land cover layer is fixed to the piezoelectric layer.

6 Claims, 12 Drawing Sheets

RECORDING HEAD AND MANUFACTURING METHOD THEREOF

CROSS REFERENCE TO RELATED APPLICATION

The present application claims priority from Japanese patent application No. 2008-240396, which was filed on Sep. 19, 2008, the disclosure of which is herein incorporated by reference in its entirety.

BACKGROUND OF THE INVENTION

1. Field of the Invention

The present invention relates to a recording head included in a recording apparatus which conducts recording on a recording medium by ejecting liquid, and to a manufacturing method of the recording head.

2. Description of Related Art

Conventionally, there has been known an ink-jet head including a piezoelectric actuator having: a piezoelectric sheet extending over a plurality of pressure chambers; a plurality of individual electrodes disposed on a surface of the piezoelectric sheet so as to face the respective pressure chambers; and a common electrode disposed so as to face the individual electrodes via the piezoelectric sheet. The piezoelectric actuator has, on a surface thereof, a plurality of bumps electrically connected to the individual electrodes or the common electrode. These bumps are respectively bonded to a plurality of lands disposed on a portion of a flat cable which is near one end thereof. The flat cable has a wiring pattern formed thereon, of which traces are respectively connected to a plurality of terminals and connected to a driver IC.

When the other end of the flat cable is pulled upwardly during a printer manufacturing process or the like, a force is exerted to bonded points between the bumps and lands in a direction that the lands are separated from the respective bumps. As a result, a land may be separated from a corresponding bump. As a technique to prevent this event, for example, there has been known a technique of covering a surface of the flat cable with a cover film to fix the flat cable to a surface of the actuator unit so that a plurality of terminals connected to the flat cable are exposed.

SUMMARY OF THE INVENTION

According to the above-described technique, the cover film of the flat cable is fixed to the surface of the actuator unit in a manner that the cover film covers areas respectively surrounding the lands bonded to the respective bumps disposed on the actuator unit. Therefore, in a region of the surface of the actuator unit where the bumps are not disposed, that is, at an end of the actuator unit, for example, the flat cable may sag toward the actuator unit, to be in contact with a corner of the actuator unit. Repeated contacts between the flat cable and the corner of the actuator unit may cause the corner of the actuator unit to penetrate the cover film, resulting in damage to the wiring pattern.

An object of the present invention is to provide: a recording head capable of suppressing the separation of a flat flexible substrate from an actuator unit and simultaneously reducing the possibility that the flat flexible substrate is damaged; and a manufacturing method of the recording head.

A recording head of the present invention includes: a passage unit which ejects liquid; an actuator unit which is fixed to the passage unit and causes the passage unit to eject liquid; and a flat flexible substrate which is fixed to the actuator unit and provides driving signals to the actuator unit. The actuator unit has a piezoelectric layer having a surface A facing the substrate, a plurality of individual electrodes placed on the piezoelectric layer, and a plurality of individual bumps placed on the surface A and electrically connected to the respective individual electrodes. The substrate has a base having a surface B facing the actuator unit, a plurality of lands placed on the surface B and bonded to the respective individual bumps, a plurality of wirings placed on the surface B and connected to the respective lands, an insulating land cover layer covering parts of the respective lands other than the bonded points with the respective individual bumps, and an insulating wiring cover layer covering the wirings. The wiring cover layer and the land cover layer are placed on each other to form a layered part so that the wiring cover layer is sandwiched between the land cover layer and the wirings. The piezoelectric layer and the wirings sandwich therebetween at least a part of the layered part. In the layered part, the land cover layer is fixed to the piezoelectric layer.

A manufacturing method of the present invention is for a recording head including: a passage unit which ejects liquid; an actuator unit which is fixed to the passage unit and causes the passage unit to eject liquid; and a flat flexible substrate which is fixed to the actuator unit and provides driving signals to the actuator unit. In the recording head, the actuator unit has a piezoelectric layer having a surface A facing the substrate, a plurality of individual electrodes placed on the piezoelectric layer, and a plurality of individual bumps placed on the surface A and electrically connected to the respective individual electrodes; and the substrate has a base having a surface B facing the actuator unit, a plurality of lands placed on the surface B and bonded to the respective individual bumps, a plurality of wirings placed on the surface B and connected to the respective lands, an insulating land cover layer covering parts of the respective lands other than the bonded points with the respective individual bumps, and an insulating wiring cover layer covering the wirings. The manufacturing method includes: a step of forming the wiring cover layer covering the wirings; a step of forming the land cover layer by using thermosetting resin so that the land cover layer is in a partially-cured state and covers the wiring cover layer and the lands; a step of contacting the substrate to the actuator unit so that the individual bumps penetrate the land cover layer to be connected to the respective lands and that the piezoelectric layer and the wirings sandwich therebetween at least a part of a layered part in which the wiring cover layer and the land cover layer are placed on each other; and a step of fixing the land cover layer to the piezoelectric layer by thermally curing the land cover layer as the substrate is contacted to the actuator unit.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention, with reference to the drawings.

Figure 1:
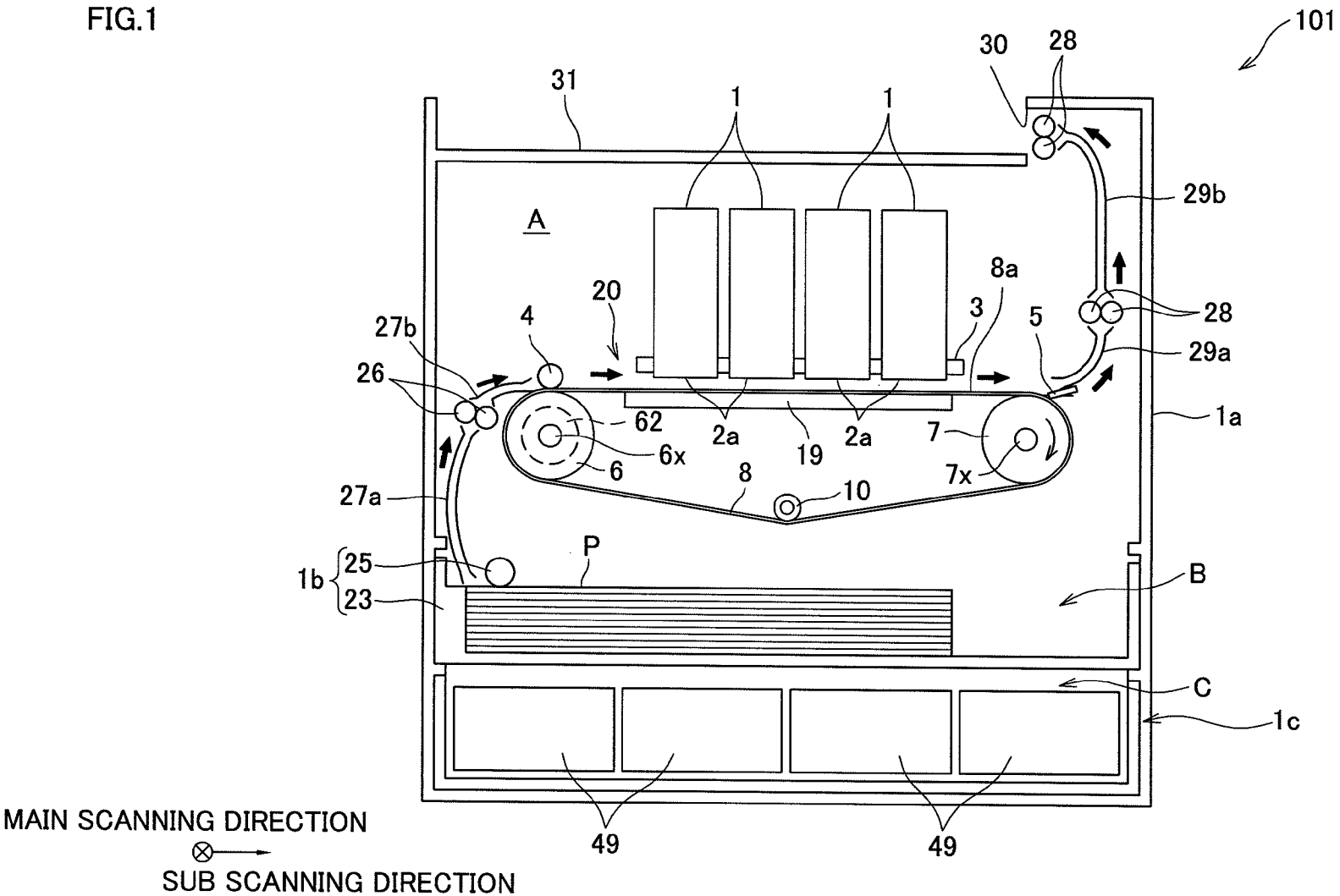
FIG. 1 is a sectional view of an ink-jet printer of one embodiment of the present invention.

As shown in FIG. 1, an ink-jet printer 101 has a housing 1*a* of a rectangular parallelepiped shape. At the top of the housing 1*a*, a paper discharger 31 is provided. In addition, the inside of the housing 1*a* is divided into three spaces A, B, and C, in this order from the top. The space A contains therein: four ink-jet heads 1 which respectively eject inks of magenta, cyan, yellow, and black; and a conveyance unit 20. The space B contains therein a paper feed unit 1*b* removable from the housing 1*a*, and the space C contains therein an ink tank unit 1*c*. Note that, in this embodiment, a sub scanning direction is a direction parallel to a conveyance direction in which a sheet P is conveyed in the conveyance unit 20, and a main scanning direction is a direction perpendicular to the sub scanning direction and parallel to a horizontal surface.

The ink-jet printer 101 includes therein a sheet conveyance path extending from the paper feed unit 1*b* to the paper discharger 31 (bold arrows in FIG. 1). A sheet P is conveyed along the sheet conveyance path. The paper feed unit 1*b* has: a paper feed tray 23 capable of containing therein a stack of sheets P; and a paper feed roller 25 attached to the paper feed tray 23. The paper feed roller 25 sends out a topmost sheet P out of the stack of sheets P contained in the paper feed tray 23. The sheet P sent out by the paper feed roller 25 is then sent to the conveyance unit 20, while being guided by the guides 27*a* and 27*b* and gripped by a pair of feed rollers 26.

As shown in FIG. 1, the conveyance unit 20 has: two belt rollers 6 and 7; an endless conveyor belt 8 looped around these rollers 6 and 7; and a tension roller 10. The tension roller 10 contacts the internal surface of the lower loop of the conveyor belt 8 and exerts a downward force to the internal surface, thereby applying tension to the conveyor belt 8. The belt roller 7 is a drive roller and rotates clockwise in FIG. 1, driven by a not-shown conveyor motor which provides a driving force to a shaft 7*x*. The belt roller 6 is a driven roller, and rotates clockwise in FIG. 1 as the conveyor belt 8 travels with the rotation of the belt roller 7.

An external surface 8*a* of the conveyor belt 8 has been treated with silicone to achieve adhesiveness. A nip roller 4 is disposed in the sheet conveyance path so as to face the belt roller 6 with the conveyor belt 8 interposed therebetween. The nip roller 4 presses a sheet P sent out from the paper feed unit 1*b* onto the external surface 8*a* of the conveyor belt 8. The sheet P pressed onto the external surface 8*a* is conveyed to the right in FIG. 1, while being held on the external surface 8*a* by its adhesiveness.

Meanwhile, a peel plate 5 is provided in the sheet conveyance path so as to face the belt roller 7 with the conveyor belt 8 interposed therebetween. The peel plate 5 peels a sheet P held on the external surface 8*a* of the conveyor belt 8 from the external surface 8*a*. The sheet P peeled from the external surface 8*a* by the peel plate 5 is conveyed while being guided by guides 29*a* and 29*b* and being gripped by two pairs of feed rollers 28, and then discharged to the paper discharger 31 from an opening 30 formed at an upper part of the housing 1*a*.

The four ink-jet heads 1, each of which extends in the main scanning direction, are aligned in the sub scanning direction, and are supported by the housing 1*a* via a frame 3. That is, the ink-jet printer 101 is a line-type color ink-jet printer having ejection regions each extending in the main scanning direction. The under surface of each ink-jet head 1 forms an ejection face 2*a* for ejection of ink droplets.

In the loop of the conveyor belt 8, a platen 19 is disposed so as to face the four ink-jet heads 1. The upper surface of the platen 19 is in contact with the internal surface of the upper loop of the conveyor belt 8, and supports the conveyor belt 8 from the inner periphery of the conveyor belt 8. With this, the external surface 8*a* of the upper loop of the conveyor belt 8 is facing and parallel to the under surfaces of the respective ink-jet heads 1, i.e., the ejection faces 2*a*, and a small gap is created between the ejection faces 2*a* and the external surface 8*a* of the conveyor belt 8. This gap constitutes a part of the sheet conveyance path. When a sheet P held on and conveyed by the external surface 8*a* of the conveyor belt 8 passes immediately under the four heads 1, different colors of ink are sequentially ejected from the respective heads 1 onto the upper surface of the sheet P, and thereby a desired color image is formed on the sheet P.

The ink-jet heads 1 are respectively connected to ink tanks 49 in the ink tank unit 1*c* attached in the space C. That is, the four ink tanks 49 reserve therein inks to be ejected by the corresponding ink-jet heads 1, respectively. From the ink tanks 49, inks are supplied to the respective ink-jet heads 1 through not-shown tubes or the like.

Figure 2:
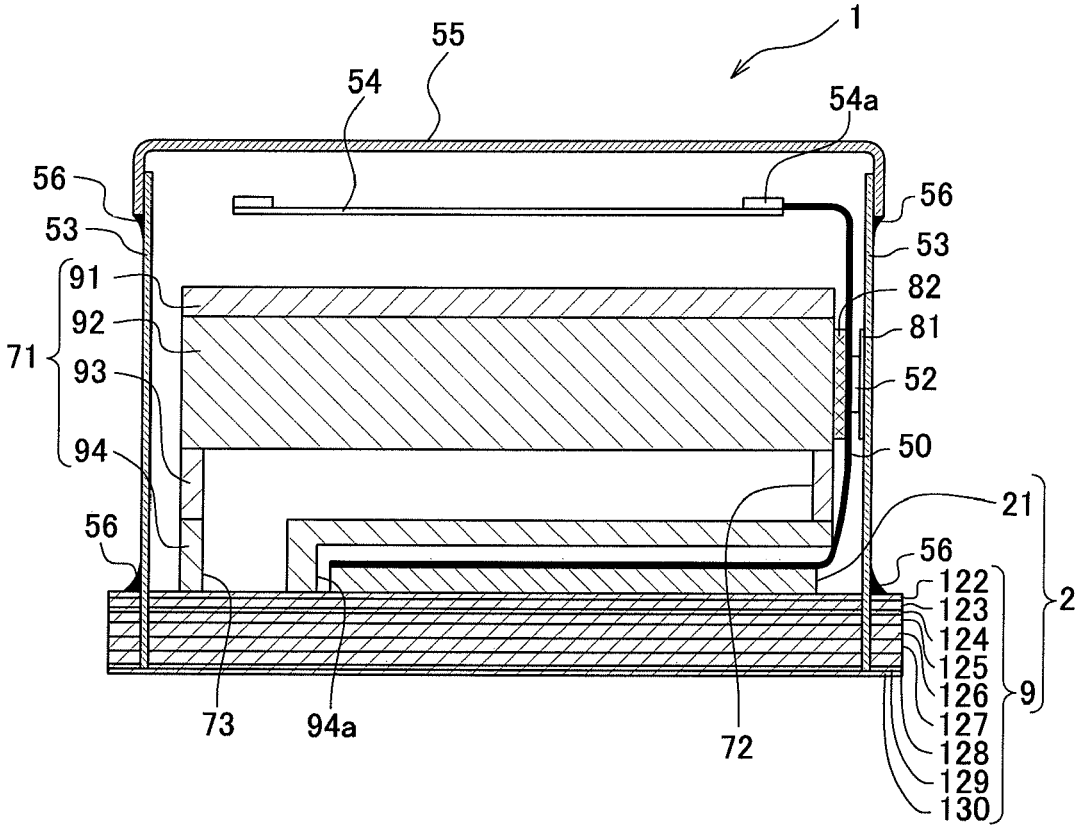
FIG. 2 is a sectional view of an ink-jet head shown in FIG. 1, along a widthwise direction (direction of a shorter side) thereof.

Next, with reference to FIG. 2, the ink-jet heads 1 will be described in detail. As shown in FIG. 2, each ink-jet head 1 has: a head main body 2 including a passage unit 9 and actuator units 21; a reservoir unit 71 which is disposed on the upper surface of the head main body 2 and supplies ink to the head main body 2; COFs (Chips On Film: flat flexible substrate) 50 each of which has one end connected to a corresponding actuator unit 21 and has a driver IC 52 mounted thereon; a control board 54 electrically connected to the COFs 50; and a side cover 53 and a head cover 55 which cover the actuator units 21, the reservoir unit 71, the COFs 50, and the control board 54, to prevent ink or ink mist from entering from outside.

The reservoir unit 71 is formed of four plates 91 to 94 which are aligned with one another and then placed upon one another. The reservoir unit 71 has therein, a not-shown ink inflow passage, an ink reservoir 72, and ten ink outflow passages 73, which are formed so that they communicate with one another. Note that, in FIG. 2, only one ink outflow passage 73 is illustrated. The ink inflow passage is a passage into which ink flows from an associated ink tank 49. The ink reservoir 72 communicates with the ink inflow passage and the ink outflow passages 73, and temporarily reserves ink therein. The ink outflow passages 73 communicate with the passage unit 9 via respective ink supply openings 105*b* (see FIG. 3) formed on the upper surface of the passage unit 9. Ink supplied from the ink tank 49 flows into the ink reservoir 72 via the ink inflow passage, then passes through the ink outflow passages 73, and is supplied to the passage unit 9 through the respective ink supply openings 105*b*.

The plate 94 has recesses 94*a* formed therein. The recesses 94*a* of the plate 94 respectively create cavities between the plate 94 and the passage unit 9. In these cavities, the actuator units 21 are respectively disposed. On the other hand, projections of the plate 94 are attached to the upper surface of the passage unit 9, and the ink outflow passages 73 are formed in the projections, respectively.

Figure 8:
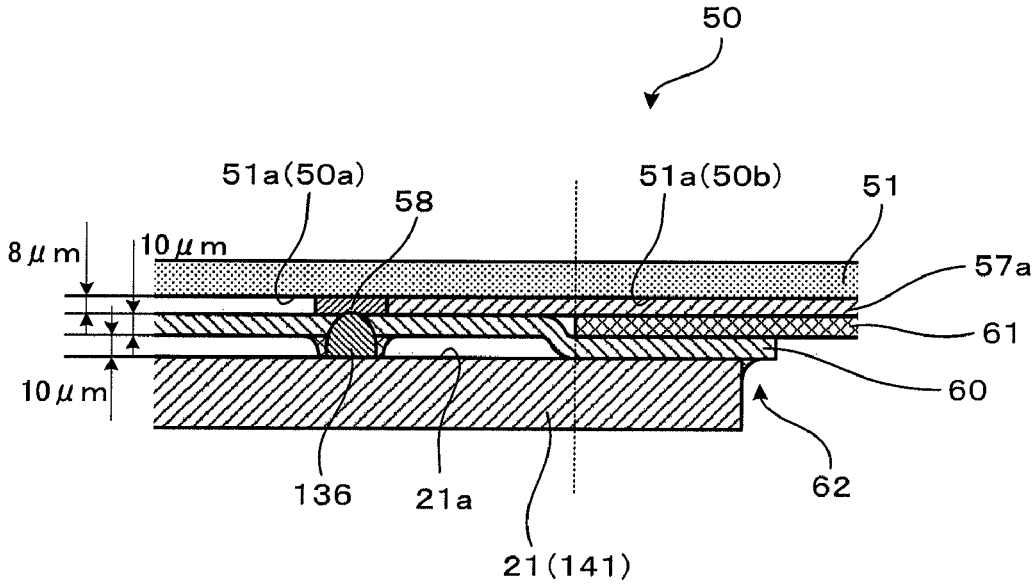
FIG. 8 is a sectional view taken along line VIII-VIII of FIG. 7.

As shown in FIG. 8, a portion of each COF 50, which is near its one end, is attached to a faying surface 21*a* that is the upper surface of a corresponding actuator unit 21 (piezoelectric sheet 141). In addition, the COF 50 is bent upwardly to form a substantially right angle so that the COF 50 includes (i) a portion horizontally extending on the faying surface 21*a* of the actuator unit 21; and (ii) a portion extending upward so as to pass between the side cover 53 and the reservoir unit 71. The other end of the COF 50 is connected to the control board 54 via a connector 54*a*. Due to this arrangement, stress may be applied to the COF 50 in a direction that the COF 50 is separated from the actuator unit 21.

Meanwhile, the driver IC 52 of each COF 50 is urged against the side cover 53 by a sponge 82 attached to a side surface of the reservoir unit 71. The driver IC 52 is closely attached to an inner surface of the side cover 53 via a heat sink sheet 81, and thereby the driver IC 52 is thermally coupled to the side cover 53. This arrangement allows the heat of the driver IC 52 to be dissipated to the outside via the side cover 53.

The control board 54 controls driving of the actuator units 21 through the driver ICs 52 of the COFs 50, respectively. The driver ICs 52 generate driving signals to drive the respective actuator units 21.

Next, the head main body 2 will be described with reference to FIGS. 3 to 6. Note that, in FIG. 4, pressure chambers 110, apertures 112, and nozzles 108, which should be illustrated with broken lines since they are below the actuator units 21, are illustrated with solid lines, for convenience of explanation.

Figure 3:
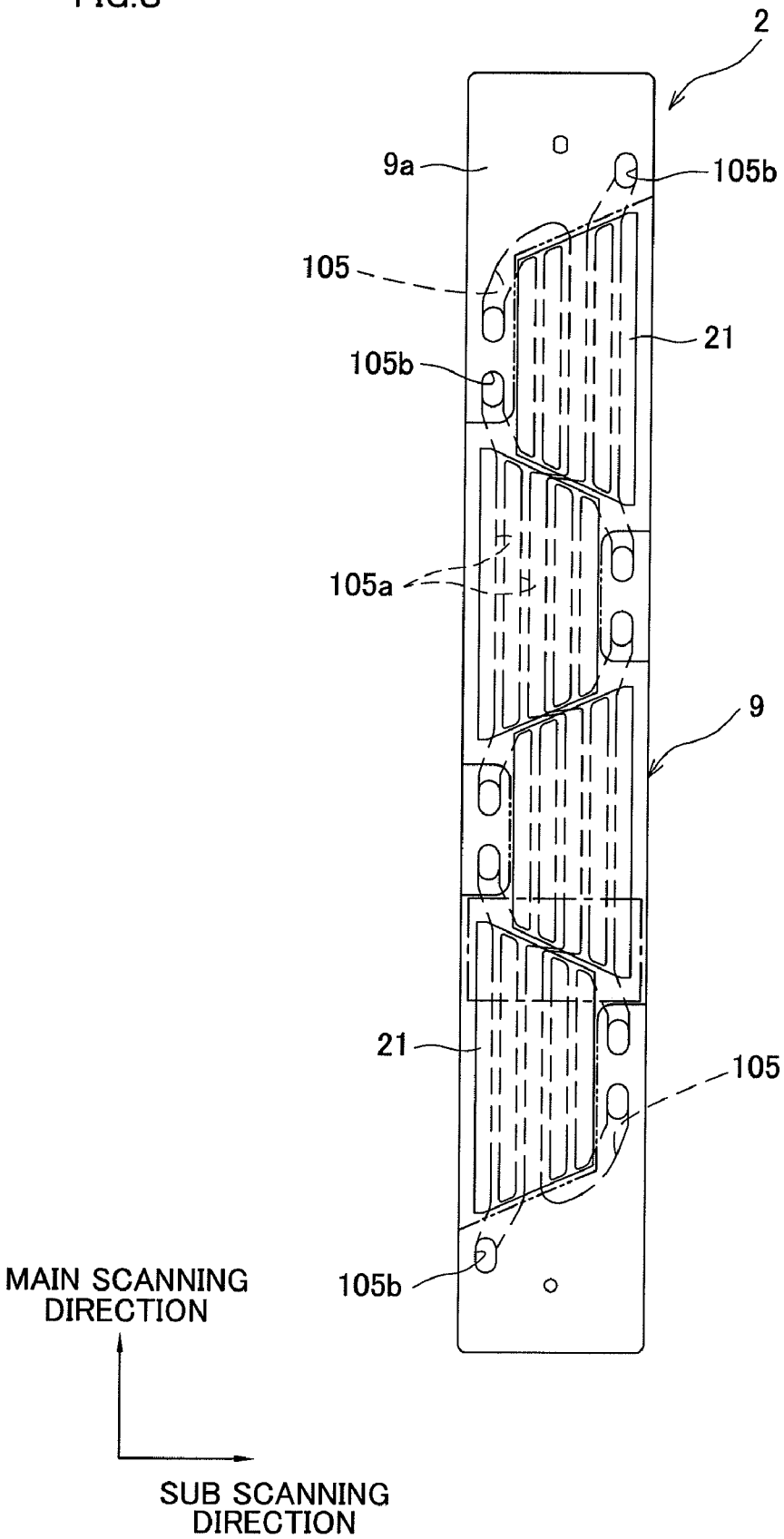
FIG. 3 is a plan view of a head main body shown in FIG. 2.
Figure 4:
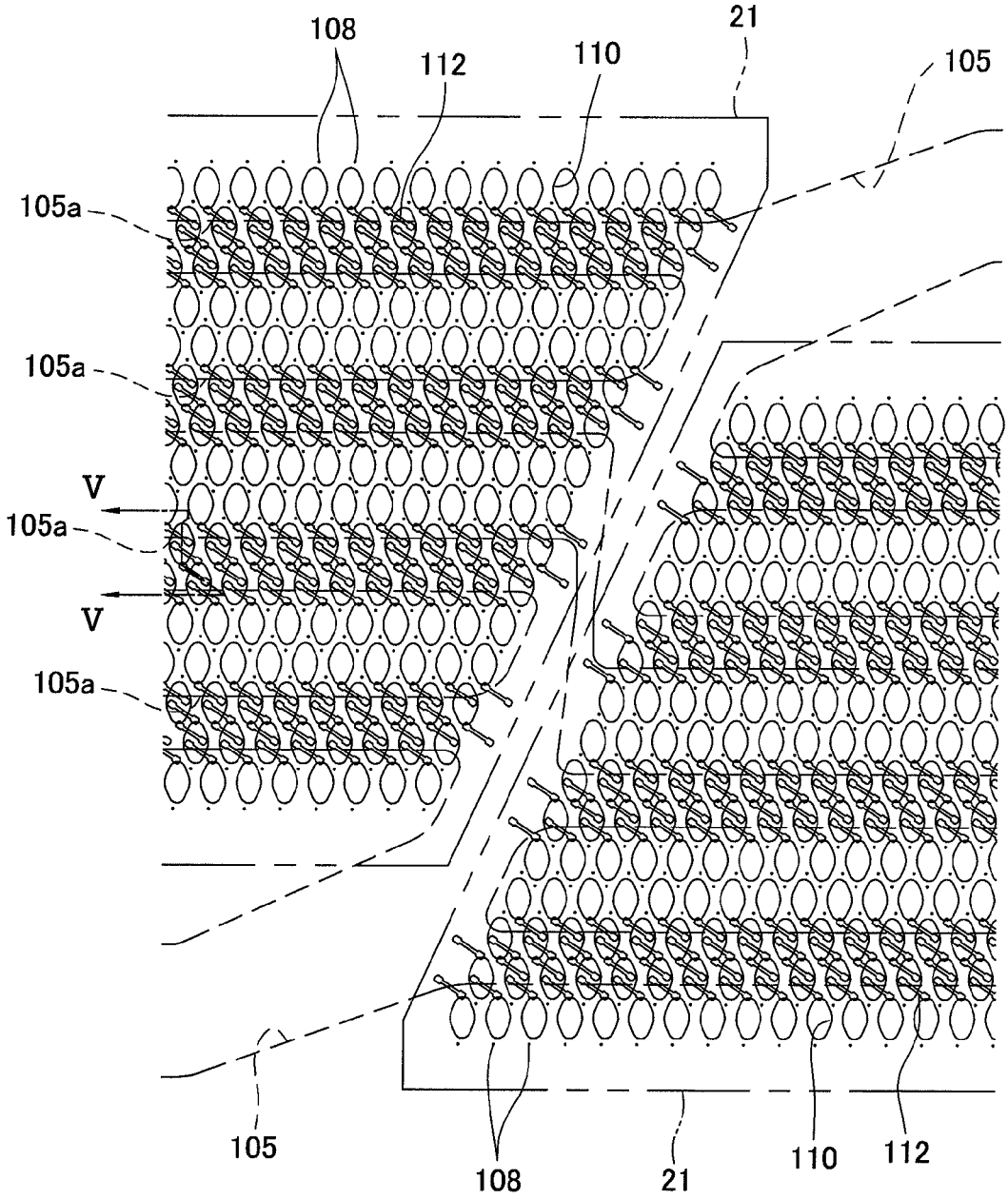
FIG. 4 is an enlarged view of a region enclosed with an alternate long and short dash line shown in FIG. 3.

As shown in FIG. 3, the head main body 2 includes: the passage unit 9; and the four actuator units 21 each fixed onto an upper surface 9*a* of the passage unit 9. As shown in FIG. 4, in the passage unit 9, ink passages including the pressure chambers 110 and the like are formed. Each actuator unit 21 has a plurality of actuators corresponding to the respective pressure chambers 110, and has a function of selectively providing ejection energy to ink in the pressure chambers 110.

Figure 5:
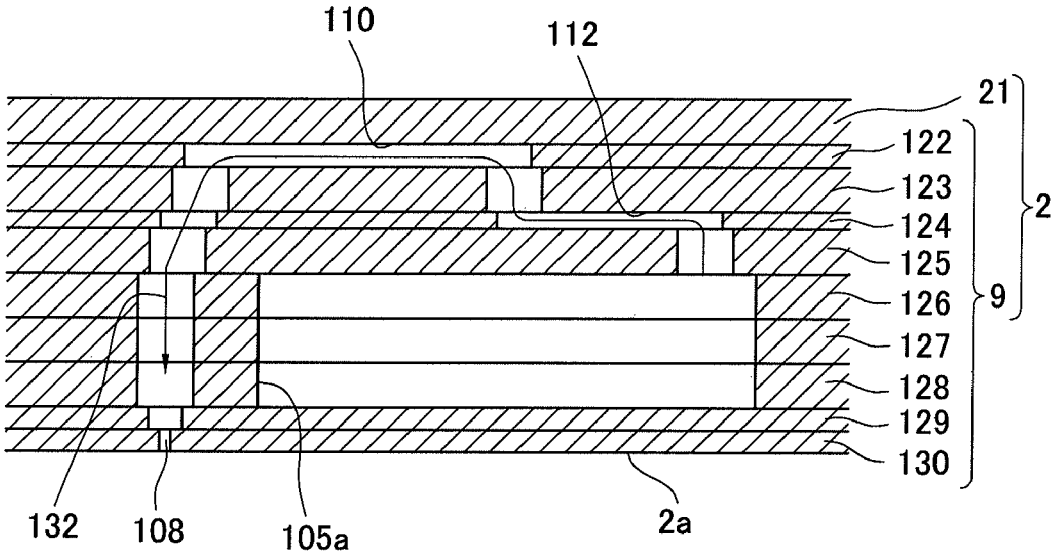
FIG. 5 is a sectional view taken along line V-V of FIG. 4.

The passage unit 9 has a substantially same shape in a plan view as that of the plate 94 of the reservoir unit 71, and has a rectangular parallelepiped shape. On the upper surface 9*a* of the passage unit 9, a total of ten ink supply openings 105*b* are provided so that the ink supply openings 105*b* respectively correspond to the ink outflow passages 73 (see FIG. 2) of the reservoir unit 71. As shown in FIGS. 3 and 4, inside the passage unit 9, there are formed: manifold channels 105 respectively communicate with the ink supply openings 105*b*; and sub manifold channels 105*a* which are branches of each manifold channel 105. As shown in FIGS. 4 and 5, the under surface of the passage unit 9 is an ejection face 2*a* where a plurality of nozzles 108 are arranged in a matrix. In the same way as the nozzles 108, the plurality of pressure chambers 110 are also arranged in a matrix on a surface of the passage unit 9, the surface having the actuator units 21 fixed thereto.

In this embodiment, sixteen rows of pressure chambers 110 are arranged so that these rows are adjacent to one another in the widthwise direction of the passage unit 9 and parallel to one another. In each of the rows, the pressure chambers 110 are aligned at regular intervals in the longitudinal direction of the passage unit 9. The pressure chambers 110 are arranged to be fitted to a later-described external shape of each actuator unit 21, which is a trapezoid. In other words, the number of pressure chambers 110 of each row gradually decreases in such a manner that: the row closest to the longer side (lower base) of the trapezoid has the largest number of pressure chambers 110; and the row closest to the shorter side (upper base) of the trapezoid has the smallest number of pressure chambers 110. The nozzles 108 are arranged in the same way.

As shown in FIG. 5, the passage unit 9 is formed of nine metal plates 122 to 130 made of stainless steel. These plates 122 to 130 are placed upon one another while being aligned with one another. As a result, the passage unit 9 has a plurality of individual ink passages 132 formed therein, each of which extends from a manifold channel 105 to a sub manifold channel 105*a*, and further extends from the outlet of the sub manifold channel 105*a* to a nozzle 108 via a pressure chamber 110.

Here, ink flow in the passage unit 9 will be described. As shown in FIGS. 3 to 5, ink supplied from the reservoir unit 71 into the passage unit 9 via the ink supply openings 105*b* branches at the points where the manifold channels 105 branch into the sub manifold channels 105*a*. Ink in the sub manifold channels 105*a* flows into the respective individual ink passages 132, passes through the apertures 112 each functioning as a throttle and the pressure chambers 110, respectively, and arrives at the associated nozzles 108.

The following describes the actuator units 21. As shown in FIG. 3, the four actuator units 21, each of which has a trapezoidal shape in a plan view, are arranged in a staggered fashion so that the actuator units 21 do not overlap the ink supply openings 105*b*. In addition, the sides of each actuator unit 21 which are parallel to and facing each other are along the longitudinal direction of the passage unit 9, in a plan view. Two adjacent oblique sides, which are respectively included in two adjacent actuator units 21, overlap each other when viewed from the sub scanning direction, that is, the widthwise direction of the passage unit 9.

Figure 6A:
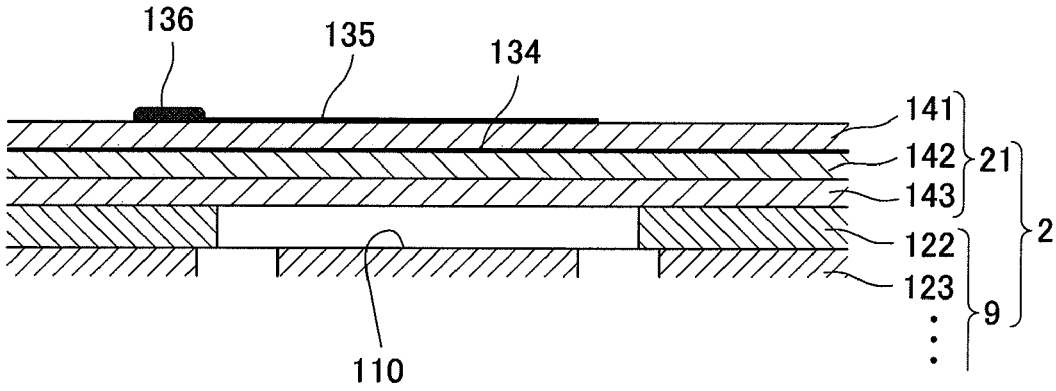
FIGS. 6A and 6B are diagrams for describing an actuator unit shown in FIG. 4.
Figure 6B:
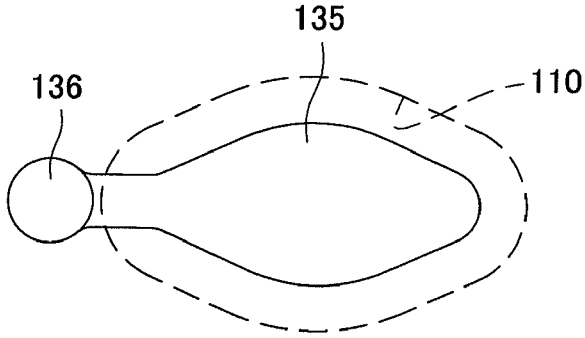

As shown in FIG. 6A, each actuator unit 21 is formed of three piezoelectric sheets 141 to 143 made of lead zirconate titanate (PZT)-base ceramic material having ferroelectricity. The under surface of the lowermost piezoelectric sheet 143 is a surface fixed to the passage unit 9. Meanwhile, the upper surface of the uppermost piezoelectric sheet 141 is the faying surface 21*a* facing a corresponding COF 50. Individual electrodes 135 are respectively formed at portions of the faying surface 21*a* which face the respective pressure chambers 110. Between the uppermost piezoelectric sheet 141 and the piezoelectric sheet 142 which is below the piezoelectric sheet 141, there is interposed a common electrode 134 formed across the entire surfaces of the sheets. As shown in FIG. 6B, each individual electrode 135 has a substantially rhombus shape in a plan view analogous to that of a pressure chamber 110. In a plan view, most part of the individual electrode 135 is located within the region of the corresponding pressure chamber 110. One of the acute angles of the individual electrode 135 of a substantially rhombus shape is extended to the outside of the region of the pressure chamber 110. At a leading end of such an extended portion, there is provided an individual bump 136 which is electrically connected to a corresponding individual electrode 135 and protruded from the faying surface 21*a*. Note that, not only the individual bumps 136 for the respective individual electrodes, but also individual bumps 136 for the common electrode are formed on the faying surface 21*a*, which bumps are electrically connected to the common electrode 134.

To all the regions of the common electrode 134 which respectively correspond to the pressure chambers 110, ground potential is applied uniformly. On the other hand, the individual electrodes 135 are electrically connected to respective output terminals of the driver IC 52 via its COF 50, and driving signals from the driver IC 52 are selectively supplied to the individual electrodes 135.

Now, a driving method of each actuator unit 21 will be described. The piezoelectric sheet 141 is polarized in the thickness direction thereof. When an electric field is applied to the piezoelectric sheet 141 in its polarization direction with each individual electrode 135 being kept at a potential different from that of the common electrode 134, a portion of the piezoelectric sheet 141 to which the electric field is applied acts as an active portion strained by a piezoelectric effect. Therefore, in each actuator unit 21, a portion sandwiched between each individual electrode 135 and a corresponding pressure chamber 110 acts as an individual actuator. In other words, each actuator unit 21 has a plurality of actuators constructed therein, the number of which is corresponding to the number of pressure chambers 110. For example, when the polarization direction is same as a direction in which an electric field is applied, the active portion is contracted in a direction perpendicular to the polarization direction (in a plane direction). That is, each actuator unit 21 is a so-called unimorph-type actuator, in which: one upper piezoelectric sheet 141 farther from the pressure chambers 110 is a layer including an active portion; and two lower piezoelectric sheets 142 and 143 closer to the pressure chambers 110 are inactive layers. As shown in FIG. 6A, the piezoelectric sheets 141 to 143 are fixed onto the upper surface of the plate 122 defining the pressure chambers 110. Therefore, when a difference occurs in strain in the plane direction between a portion of the piezoelectric sheet 141 where an electric field is applied and portions of the respective piezoelectric sheets 142 and 143 below that portion, the piezoelectric sheets 141 to 143 as a whole deform so as to project toward a corresponding pressure chamber 110 (i.e., unimorph deformation). As a result, pressure (ejection energy) is applied to the ink in the pressure chamber 110, and thereby an ink droplet is ejected from a corresponding nozzle 108.

In this embodiment, driving signals are output from a corresponding driver IC 52 in such a way that, every time ejection is required, an individual electrode 135 which has been kept at a predetermined potential in advance is temporarily brought to ground potential and then the individual electrode 135 is brought to the predetermined potential again at a predetermined timing. In this structure, the piezoelectric sheets 141 to 143 return to their original state when the individual electrode 135 is brought to ground potential. This increases the capacity of a corresponding pressure chamber 110, compared to the capacity in its initial state, that is, a state where voltage has been applied in advance. As a result, ink is sucked from a corresponding sub manifold channel 105*a* into a corresponding individual ink passage 132. Then, when the individual electrode 135 is brought to the predetermined potential, the portions of the respective piezoelectric sheets 141 to 143 which face an active portion are deformed so as to project toward the pressure chamber 110. This decreases the capacity of the pressure chamber 110, and therefore increases the pressure applied to the ink. As a result, the ink is ejected from a corresponding nozzle 108.

Next, each COF 50 will be described in detail with reference to FIGS. 7 to 9. Note that, in FIGS. 7 and 9, the external shape of an actuator unit 21 to which the COF 50 is fixed is indicated with broken lines. In addition, the longitudinal length of the COF 50 is illustrated as being shorter. As shown in FIG. 8, the COF 50 has a film-like base 51 having a surface 51*a* which faces the faying surface 21*a* of the actuator unit 21. On the surface 51*a* of the base 51, there are formed: a land region 50*a* having a trapezoidal external shape in a plan view substantially same as that of the actuator unit 21; and a wiring region 50*b* which is adjacent to the longer side of the land region 50*a* and extends from the land region 50*a* toward the outside (downward in FIG. 7). In FIG. 8, a region to the left of a broken line is the land region 50*a*, and a region to the right of the broken line is the wiring region 50*b*. An end of the wiring region 50*b*, which end is farther from the land region 50*a*, is connected to a terminal section 50*c* to be connected to a corresponding connector 54*a* of the control board 54. It should be noted that, a boundary line between the land region 50*a* and the wiring region 50*b* may be anywhere as long as the line is between a land 58 closest to the wiring region 50*b* and an end surface of a layered part 62 which surface is closest to the land region 50*a*.

In the land region 50*a* of the base 51, a plurality of lands 58 are disposed which are to be respectively bonded to the plurality of individual bumps 136 of the actuator unit 21. The driver IC 52 is mounted on a portion between the both longitudinal ends of the wiring region 50*b* of the base 51. In the wiring region 50*b*, there are formed: output wirings 57*a* connected to the lands 58 and also connected to the not-shown output terminals of the driver IC 52; and control wirings 57*b* which respectively connect not-shown control terminals of the driver IC 52 and terminals of the terminal section 50*c*.

On the surface 51*a* of the base 51, an insulating solder resist 61 functioning as a wiring cover layer is formed, which covers the whole wiring region 50*b* and is made of thermosetting epoxy resin. In addition, on the surface 51*a*, a cover coat 60 functioning as a land cover layer is formed, which covers: (i) the whole land region 50*a* other than the bonded points between the individual bumps 136 and the respective lands 58; and (ii) a portion of the solder resist 61, which faces a quadrangular region in the wiring region 50*b*, the region being adjacent to the longer side of the land region 50*a*. The cover coat 60 is made of thermosetting epoxy resin and has insulation property. The layered part 62 is a part where the solder resist 61 and the cover coat 60 are layered on each other so that the solder resist 61 is sandwiched between the cover coat 60 and the output wirings 57*a*. In addition, a portion of the layered part 62 which faces the faying surface 21*a* of the actuator unit 21 is held and sandwiched by the faying surface 21*a* and the output wirings 57*a*. In the layered part 62, the cover coat 60 is fixed to the faying surface 21*a*.

As shown in FIG. 8, the individual bumps 136 of the actuator unit 21 are formed so as to be protruded from the faying surface 21*a*, and the leading ends of the individual bumps 136 penetrate the cover coat 60 and are bonded to the respective lands 58. Thus, the individual bumps 136 are covered with the cover coat 60 except the respective leading ends thereof, and thereby it is possible to prevent a short circuit caused by conductive foreign matters intruding between individual bumps 136 adjacent to each other.

In the vicinity of the bonded points between the individual bumps 136 and the respective lands 58, a height from the faying surface 21*a* to the base 51 is approximately 30 μm. A thickness of the output wirings 57*a* is 8 μm, and a thickness of the cover coat 60 and a thickness of the solder resist 61 are 10 μm. Therefore, in the layered part 62, a height from the faying surface 21*a* to the base 51 is 28 μm. Accordingly, the base 51 extends substantially parallel to the faying surface 21*a*.

Figure 7:
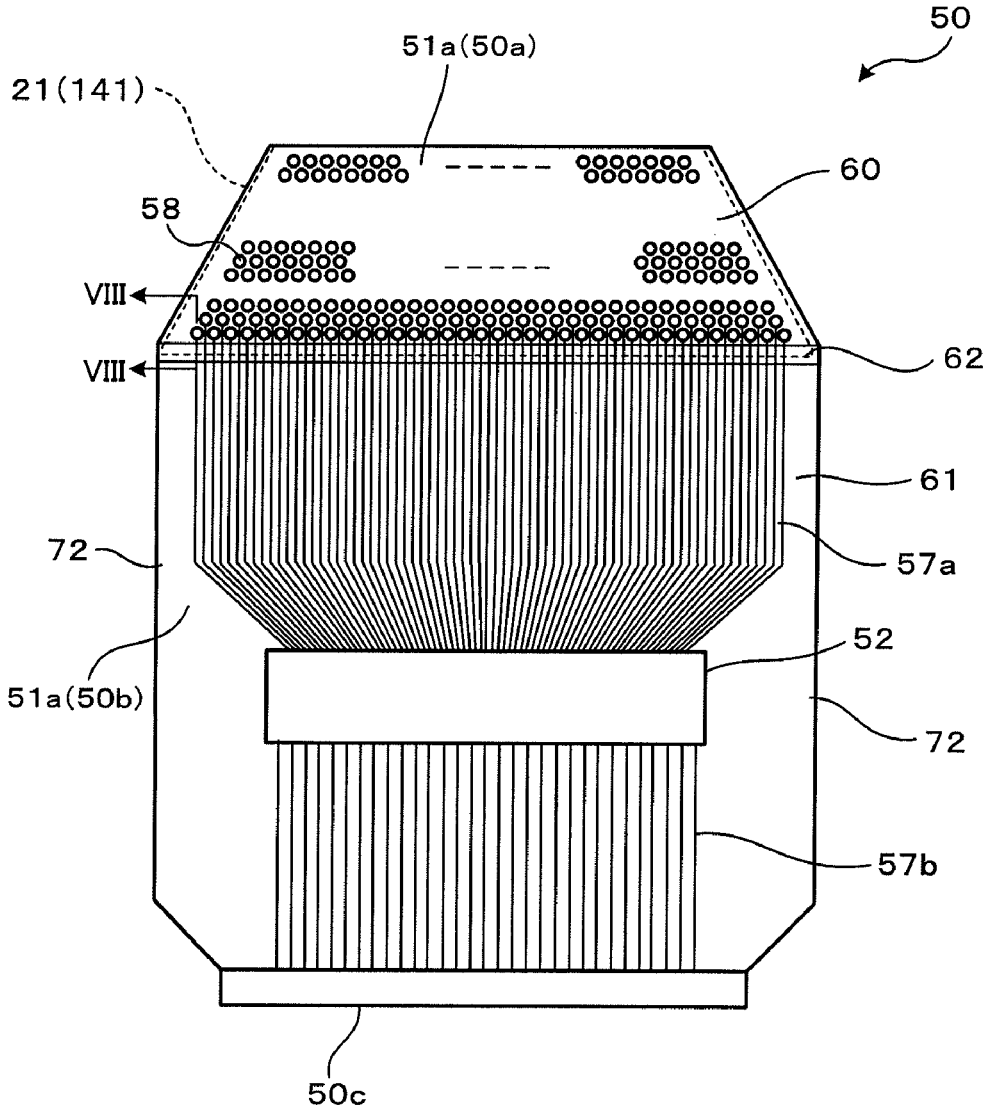
FIG. 7 is a plan view of a COF shown in FIG. 2, illustrating a surface thereof on which a driver IC is mounted.
Figure 9:
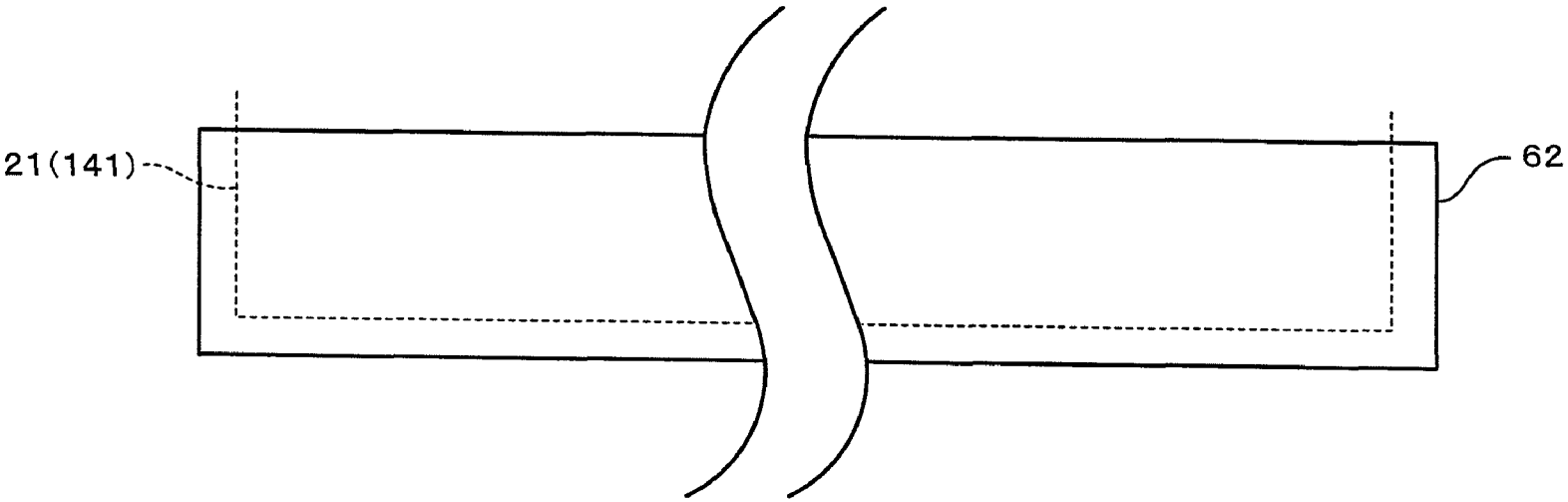
FIG. 9 is an enlarged view of a layered part shown in FIG. 7.

As shown in FIGS. 7 to 9, in the layered part 62, the cover coat 60 extends, so that the leading end thereof is farther from the lands 58 than the edge of the actuator unit 21 is, in a direction in which the output wirings 57*a* extend in a parallel part where the output wirings 57*a* extend parallel to one another (an up and down direction in FIG. 7) (hereinafter that direction may be referred to as an "extending direction of the output wirings 57*a*"). In addition, the layered part 62 faces all the output wirings 57*a*, and has such a shape, in a plan view, that the layered part 62 extends beyond the both ends of the actuator unit 21 in a direction perpendicular to the extending direction (hereinafter that direction may be referred to as a "perpendicular direction of the extending direction of the output wirings 57*a*"). As described later, in a step of closely contacting the COF 50 to the actuator unit 21, the cover coat 60 which is partially-cured is closely contacted to the faying surface 21*a* of the actuator unit 21. At this time, the cover coat 60 is crushed by the faying surface 21*a*. As a result, the cover coat 60 is extended over the faying surface 21*a*, to a side surface of the actuator unit 21 extending along the longer side and to portions of the respective two side surfaces of the actuator unit 21 extending along the two oblique sides respectively, the portions located below the layered part 62. The cover coat 60 is thermally cured in this state, and thereby the cover coat 60 is firmly fixed to the actuator unit 21.

Figure 10:
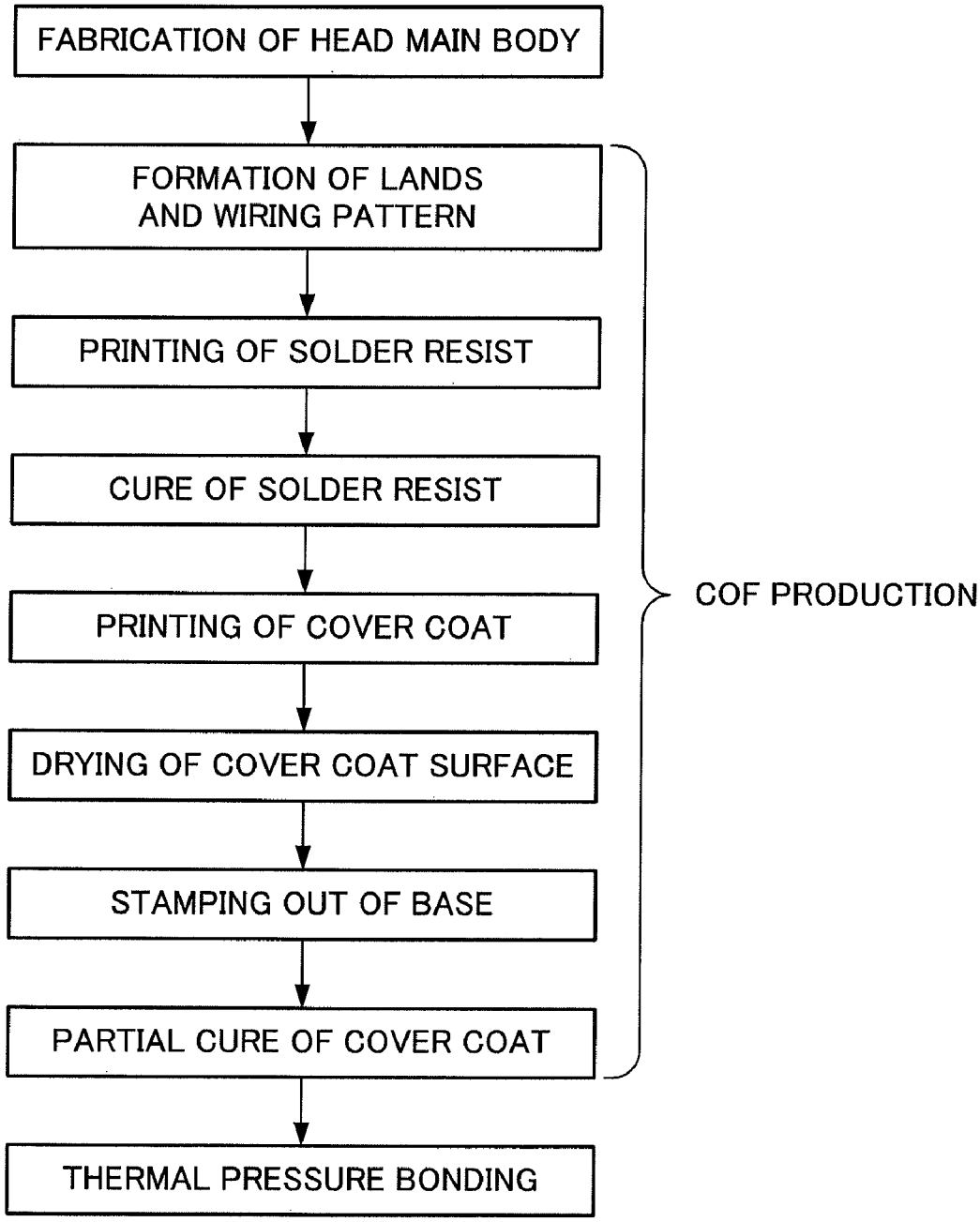
FIG. 10 is a block diagram for describing a process flow of bonding the COF shown in FIG. 2 to a corresponding actuator unit.
Figure 11A:
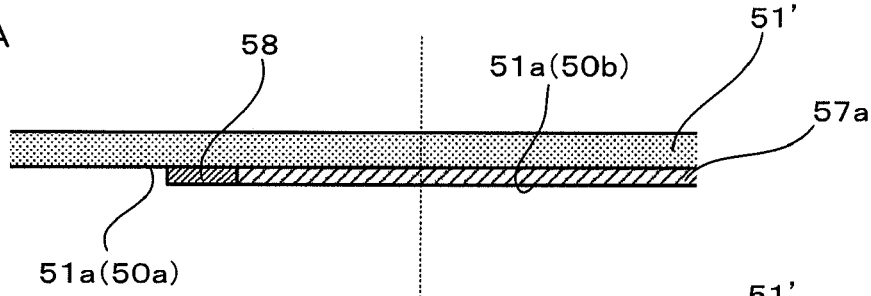
FIGS. 11A to 11C are diagrams for describing process steps shown in FIG. 10.

In the process of manufacturing each ink-jet head 1, the following describes a process flow of forming the COFs 50 and then closely contacting each of the COFs 50 to a corresponding actuator unit 21, with reference to FIGS. 10 and 11. First, as shown in FIG. 10, the individual bumps 136 are formed on the faying surface 21*a* of each actuator unit 21 fixed to the passage unit 9 so that the individual bumps 136 are protruded from the faying surface 21*a*, and thereby the head main body 2 is fabricated ("fabrication of head main body") ("terminals forming step").

Next, each COF 50 is produced. The plurality of lands 58, a plurality of wiring pattern traces including the output wirings 57*a* and the control wirings 57*b*, and lands for mounting the driver IC 52 thereto, are formed on a sheet material 51', which is to be the base 51 of the COF 50 ("formation of lands and wiring pattern"). Then, the driver IC 52 is mounted to these lands.

Figure 11B:
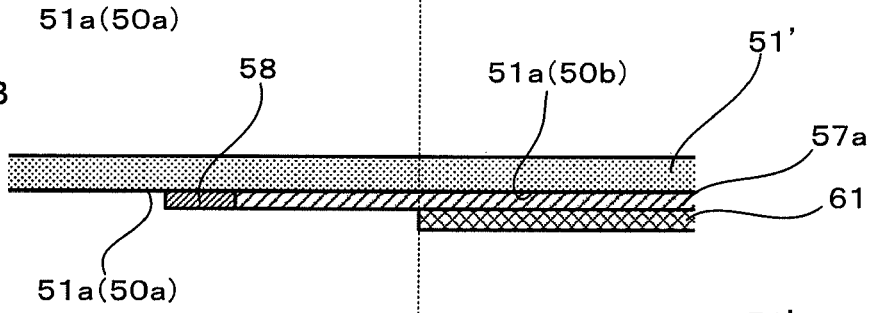

Then, as shown in FIGS. 10 and 11B, printing of the solder resist 61 is conducted by applying thermosetting epoxy resin so as to cover the wiring region 50*b* including the output wirings 57*a* and the control wirings 57*b* ("printing of solder resist"). Then, the solder resist 61 is heated to be completely cured ("cure of solder resist") (so far, "wiring cover layer forming step").

Figure 11C:
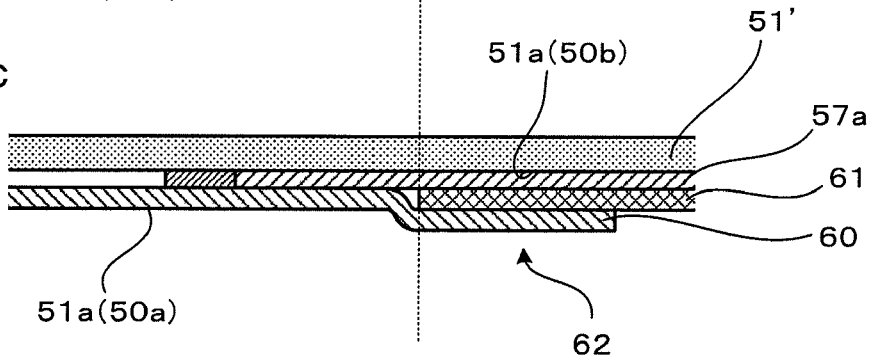

Further, as shown in FIGS. 10 and 11C, printing of the cover coat 60 is conducted by applying thermosetting epoxy resin so as to cover: the whole land region 50*a* including the lands 58; and a portion of the wiring region 50*b* which is formed contiguously with the longer side of the land region 50*a* (that is, the layered part 62) ("printing of cover coat"). In this process, the layered part 62 where the cover coat 60 covers a part of the solder resist 61 is formed in the wiring region 50*b*. As described above, in the layered part 62, the cover coat 60 extends in the extending direction of the output wirings 57*a* so that the leading end of the cover coat 60 is farther from the lands 58 than the edge of the actuator unit 21 is, and the cover coat 60 also extends beyond the both ends of the actuator unit 21 in the perpendicular direction of the extending direction of the output wirings 57*a*.

Then, the surface of the cover coat 60 is dried ("drying of cover coat surface"). This makes it possible to prevent the cover coat 60 from losing its shape when the sheet material 51' is handled. After that, the base 51 is stamped out from the sheet material 51' ("stamping out of base"). Further, the cover coat 60 is heated to be partially cured ("partial cure of cover coat") (so far, "land cover layer forming step"). As a result, each COF 50 is completed. Note that, the partial cure of cover coat may be conducted before the base is stamped out.

After that, the faying surface 21*a* of the actuator unit 21 and the land region 50*a* of the COF 50 are placed so as to face each other, and then pressurized so that the faying surface 21*a* and the land region 50*a* become close to each other. This causes the individual bumps 136 to penetrate the cover coat 60, thereby establishing contacts with the lands 58 respectively facing the individual bumps 136. At this time, the solder resist 61 and a portion of the cover coat 60 which covers the solder resist 61 are held and sandwiched between the faying surface 21*a* and the output wirings 57*a*. Therefore, as shown in FIG. 8, the cover coat 60 closely contacts the faying surface 21*a*. In this process, in the layered part 62, the cover coat 60 is crushed by the faying surface 21*a*, and thereby the cover coat 60 is extended over the faying surface 21*a*, to a side surface of the actuator unit 21 extending along the longer side and to portions the respective two side surfaces of the actuator unit 21 extending along the two oblique sides respectively, the portions located below the layered part 62 (so far, "contacting step").

Then, a heating and pressurization process is conducted. As a result, the cover coat 60 is cured, with the individual bumps 136 and the lands 58, which are respectively in contact with each other, being electrically connected. In this process, the cover coat 60 entirely surrounds, in a plan view, the bonded points between the individual bumps 136 and the respective lands 58, and the cover coat 60 connects the faying surface 21*a* and the base 51. In addition, as a result of curing the cover coat 60, the cover coat 60 is firmly fixed to the actuator unit 21 ("thermal pressure bonding") (so far, "land cover layer curing step"). Here, a height from the faying surface 21*a* to the base 51 in the vicinity of the bonded points between the individual bumps 136 and the respective lands 58 is substantially same as the total thickness of the output wirings 57*a*, the cover coat 60, and the solder resist 61. Accordingly, the base 51 extends substantially parallel to the faying surface 21*a*.

As described above, in each ink-jet head 1 of this embodiment, the cover coat 60 which covers the solder resist 61 in the wiring region 50*b* is fixed to the faying surface 21*a* of each actuator unit 21, and therefore it is possible to withstand stress applied from a corresponding COF 50 to the bonded points between the individual bumps 136 and the respective lands 58. Accordingly, it is possible to reduce the possibility that a land 58 is separated from a corresponding individual bump 136. In addition, between the faying surface 21*a* and the wiring region 50*b*, the cover coat 60 and the solder resist 61 are interposed. This structure ensures that, in a region where the cover coat 60 is fixed to the faying surface 21*a*, the clearance between the base 51 and the actuator unit 21 is not smaller than the thickness of the solder resist 61. This makes it possible to prevent the COF 50 closely contacted to the actuator unit 21 from curving toward the actuator unit 21. Accordingly, it is possible to prevent damage to the output wirings 57*a* due to a contact between the wirings 57*a* and a corner of the actuator unit 21.

In addition, the base 51 extends parallel to the faying surface 21*a*, and this makes it possible to surely prevent the COF 50 closely contacted to the actuator unit 21 from curving toward the actuator unit 21.

Furthermore, in the layered part 62, the cover coat 60 extends in the extending direction of the output wirings 57*a* so that the leading end of the cover coat 60 is farther from the lands 58 than the edge of the actuator unit 21 is. The layered part 62 has such a shape, in a plan view, that the layered part 62 extends beyond the both ends of the actuator unit 21 in the perpendicular direction of the extending direction of the output wirings 57*a*. With this structure, when the partially-cured cover coat 60 is closely contacted to the faying surface 21*a* of the actuator unit 21 in the step of closely contacting the COF 50 to the actuator unit 21, the cover coat 60 is crushed by the faying surface 21*a* in the layered part 62, and thereby the cover coat 60 is extended over the faying surface 21*a*, to a side surface of the actuator unit 21 extending along the longer side and to portions of the respective two side surfaces of the actuator unit 21 extending along the two oblique sides respectively, the portions located below the layered part 62. This allows the cover coat 60 to be firmly fixed to the actuator unit 21.

<Modification>

Figure 12:
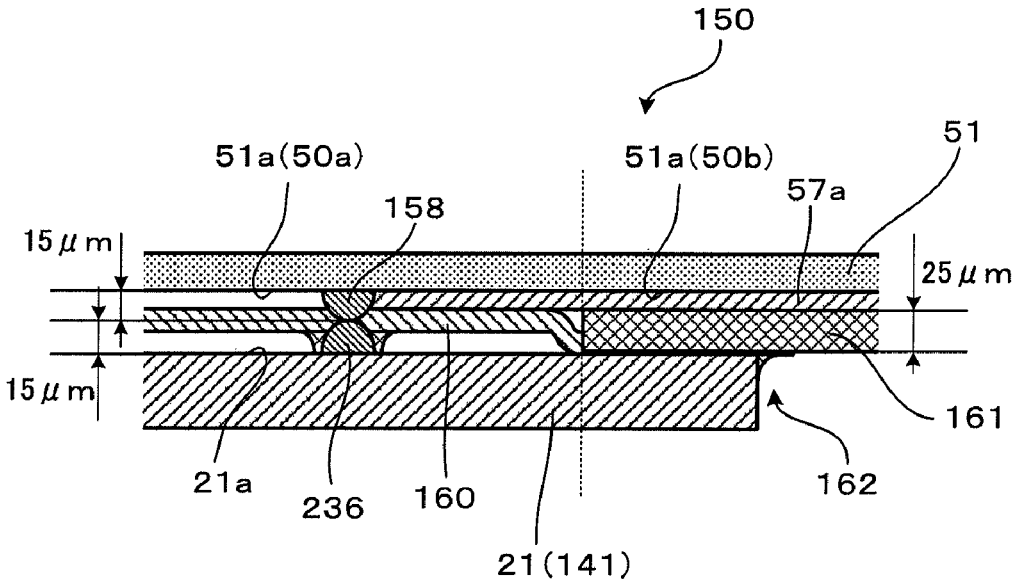
FIG. 12 is a diagram for describing a modification.

The following describes a modification of this embodiment with reference to FIG. 12. As shown in FIG. 12, individual bumps 236 protruded from the faying surface 21*a* of each actuator unit 21, each has a height of 15 μm. Meanwhile, lands 158 protruded from a surface of the base 51, each has a height of 15 μm. The individual bumps 236 and the lands 158 penetrate a cover coat 160, and the individual bumps 236 are respectively bonded to the lands 158. With this, in the vicinity of the bonded points between the bumps 236 and the respective lands 158, a height from the faying surface 21*a* to the base 51 is approximately 30 μm.

On the other hand, a thickness of a solder resist 161 is 25 μm, and in a layered part 162, the cover coat 160 is smaller in thickness than the solder resist 161. This is because the cover coat 160 is crushed by the faying surface 21*a* when a COF 50 is closely contacted to the actuator unit 21. Therefore, the thickness of the solder resist 161 substantially equals to a value difference between a thickness of the output wirings 57*a* and the total height of an individual bump 236 and a land 158 which are bonded to each other (that is, a distance between the faying surface 21*a* and the base 51 in the vicinity of the individual bump 236 and the land 158).

In this structure, it is possible to reduce the amount of thermosetting epoxy resin to be applied at the time of forming the cover coat 160. This results in a reduction in an amount of the cover coat 160 overflowing from the space between the solder resist 161 and the faying surface 21*a*. Further, this can reduce the possibility that the overflowing cover coat 160 blocks the deformation of the actuator unit 21.

The above-described embodiment has a structure such that: the height from the faying surface 21*a* to the base 51 in the vicinity of the bonded points between the individual bumps 136 and the respective lands 58 is substantially same as the height from the faying surface 21*a* to the base 51 in the layered part 62; and thereby the base 51 extends parallel to the faying surface 21*a*. However, the height from the faying surface 21*a* to the base 51 in the layered part 62 may be set to be greater than the height from the faying surface 21*a* to the base 51 in the vicinity of the bonded points between the individual bumps 136 and the respective lands 58. This structure allows the base 51 to curve in a direction away from the actuator unit 21.

In the above-described embodiment, each actuator unit 21 is a unimorph type actuator; however, each actuator unit may be a bimorph type actuator.

Further, the layered part 62 may have any shape, in a plan view, corresponding to the shape of the base. For example, the layered part 62 may have an elliptic shape in a plan view, or may be formed into a plurality of quadrangular shapes in a plan view.

A recording head of the present invention is not limited to a head for a line-type device, but also applicable to a serial-type device having a reciprocating head. In addition, the application of the present invention is not limited to a printer, but the present invention is applicable to a facsimile machine, a copying machine, and the like.

In the above-described embodiment, the cover coat 60 covers a part of the solder resist 61. However, the cover coat may cover the whole solder resist. In this case, the layered part includes the whole solder resist.

In the above-described embodiment, in the layered part 62, the cover coat 60 extends in the extending direction of the output wirings 57*a* so that the leading end of the cover coat 60 is farther from the lands 58 than the edge of the actuator unit 21 is. However, the leading end of the cover coat may be on the piezoelectric sheet. In this case, the entire layered part is held and sandwiched between the piezoelectric sheet and the wirings.

In the above-described embodiment, the individual electrodes 135 are provided on the upper surface of the piezoelectric sheet 141 and the common electrode 134 is provided between the piezoelectric sheet 141 and the piezoelectric sheet 142. However, the individual electrodes 135 and the common electrode 134 may be placed in an opposite manner, that is, in such a manner that the common electrode 134 is provided on the upper surface of the piezoelectric sheet 141, and the individual electrodes 135 are provided between the piezoelectric sheet 141 and the piezoelectric sheet 142.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording head comprising:

a passage unit which ejects liquid; an actuator unit which is fixed to the passage unit and causes the passage unit to eject liquid; and a flat flexible substrate which is fixed to the actuator unit and provides driving signals to the actuator unit, wherein the actuator unit has a piezoelectric layer having a surface A facing the to substrate, a plurality of individual electrodes placed on the piezoelectric layer, and a plurality of individual bumps placed on the surface A and electrically connected to the respective individual electrodes, wherein the substrate has a base having a surface B facing the actuator unit, a plurality of lands placed on the surface B and bonded to the respective individual bumps, a plurality of wirings placed on the surface B and connected to the respective lands, an insulating land cover layer covering parts of the respective lands other than the bonded points with the respective individual bumps, and an insulating wiring cover layer covering the wirings, wherein the wiring cover layer and the land cover layer are placed on each other to form a layered part so that the wiring cover layer is sandwiched between the land cover layer and the wirings, wherein the piezoelectric layer and the wirings sandwich therebetween at least a part of the layered part, and wherein in the layered part, the land cover layer is fixed to the piezoelectric layer.

2. The recording head according to claim 1, wherein the base extends parallel to the surface A.

3. A recording head comprising:

a passage unit which ejects liquid; an actuator unit which is fixed to the passage unit and causes the passage unit to eject liquid; and a flat flexible substrate which is fixed to the actuator unit and provides driving signals to the actuator unit, wherein the actuator unit has a piezoelectric layer having a surface A facing the to substrate, a plurality of individual electrodes placed on the piezoelectric layer, and wherein at least either a plurality of individual bumps or a plurality of lands are protruded from the surface A or the surface B and electrically connected to the respective individual electrodes, wherein the substrate has a base facing the actuator unit, the plurality of lands and the plurality of bumps bonded to the respective individual bumps, a plurality of wirings connected to the respective lands, an insulating land cover layer covering parts of the respective lands other than the bonded points with the respective individual bumps, and an insulating wiring cover layer covering the wirings, wherein the wiring cover layer and the land cover layer are placed on each other to form a layered part so that the wiring cover layer is sandwiched between the land cover layer and the wirings, wherein the piezoelectric layer and the wirings sandwich therebetween at least a part of the layered part, and wherein in the layered part, the land cover layer is fixed to the piezoelectric layer, and wherein the wiring cover layer has a thickness same as a value difference between a thickness of the wirings and a distance between the surface A and the surface B.

4. The recording head according to claim 3, wherein the land cover layer is smaller in thickness than a part of the wiring cover layer which is not included in the layered part.

5. The recording head according to claim 1, wherein the layered part extends so that a leading end of the layered part is farther from the lands than an edge of the piezoelectric layer in an extending direction of a parallel part of the wirings, the parallel part being a part where the wirings extend parallel to one another.

6. The recording head according to claim 5, wherein the layered part faces the wirings and has such a shape, in a plan view, that the layered part extends beyond both ends of the piezoelectric layer in a direction perpendicular to the extending direction.

* * * * *